US007944336B2

(12) United States Patent
Mizuno et al.

(10) Patent No.: US 7,944,336 B2
(45) Date of Patent: May 17, 2011

(54) LAMINATED COIL COMPONENT AND METHOD FOR MANUFACTURING THE SAME

(75) Inventors: Tatsuya Mizuno, Omihachiman (JP); Hideaki Matsushima, Echi-gun (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 12/143,050

(22) Filed: Jun. 20, 2008

(65) Prior Publication Data

US 2008/0246579 A1 Oct. 9, 2008

Related U.S. Application Data

(63) Continuation of application No. PCT/JP2006/317615, filed on Sep. 6, 2006.

(30) Foreign Application Priority Data

Dec. 23, 2005 (JP) ..... 2005-371196

(51) Int. Cl.
*H01F 5/00* (2006.01)
*H01F 27/28* (2006.01)
*H01F 7/06* (2006.01)

(52) U.S. Cl. ..... 336/200; 336/223; 336/232; 29/605

(58) Field of Classification Search ..... None
See application file for complete search history.

(56) References Cited

U.S. PATENT DOCUMENTS 4,543,553 A * 9/1985 Mandai et al. ..... 336/83
4,554,553 A * 11/1985 Grim ..... 343/786
5,647,966 A 7/1997 Uriu et al.
5,781,093 A * 7/1998 Grandmont et al. ..... 336/232
6,147,409 A 11/2000 Hsia et al.
6,229,425 B1 * 5/2001 Kobayashi ..... 336/200
6,568,054 B1 * 5/2003 Kumagai et al. ..... 29/25.42
6,853,286 B2 * 2/2005 Nikawa et al. ..... 336/200
2001/0032383 A1 * 10/2001 Haratani et al. ..... 29/25.42
2002/0008606 A1 * 1/2002 Okuyama et al. ..... 336/200

FOREIGN PATENT DOCUMENTS

JP 07-106175 A 4/1995
JP 10-012455 A 1/1998
JP 2001-176725 A 6/2001
JP 2001-274021 A 10/2001
JP 2001-358018 A 12/2001
JP 2002-273851 A 9/2002
JP 2003-209016 A 7/2003
JP 2004-087596 A 3/2004
WO 2005/052962 A1 6/2005

OTHER PUBLICATIONS

Official communication issued in counterpart European Application No. 06 79 7511, mailed on Nov. 14, 2008. Official communication issued in counterpart International Application No. PCT/JP2006/317615, mailed on Sep. 6, 2006.
Official communication issued in the International Application No. PCT/JP2006/317615, mailed on Dec. 19, 2006.

* cited by examiner

*Primary Examiner* — Anh T Mai
*Assistant Examiner* — Mangtin Lian
(74) *Attorney, Agent, or Firm* — Keating & Bennett, LLP

(57) ABSTRACT

A laminated coil component includes a spiral coil including laminated ceramic films and coil conductors. Pad portions provided at ends of the coil conductors are connected to one another using via-hole conductors to provide an interlayer connection among the pad portions. Thus, a spiral coil is provided. The pad portions are thinner than the coil conductors, and accordingly, a concentration of stress on portions at which the pad portions and the via-hole conductors overlap one another is reduced.

3 Claims, 3 Drawing Sheets

LAMINATED COIL COMPONENT AND METHOD FOR MANUFACTURING THE SAME

BACKGROUND OF THE INVENTION

1. Field of the Invention

The present invention relates to a laminated coil component such as a chip inductor and a method for manufacturing the same.

2. Description of the Related Art

In general, laminated coil components, such as chip inductors, include ceramic films and coil conductors having half-turn shapes which are laminated on one another as shown in Japanese Unexamined Patent Application Publication No. 2003-209016. In such a laminated coil component, both ends of the respective coil conductors are connected to one another through via-hole conductors, whereby a spiral coil is obtained.

With respect to such laminated coil components, in recent years, there have been demands for a reduction in the size and the height of the coil components and for improvements in the characteristics thereof. In order to meet these demands, the coil conductors have reduced line widths and increased thicknesses, the ceramic films have reduced thicknesses. However, as the thickness of the ceramic films is reduced, stress is concentrated on portions in which via-hole conductors overlap one another in a laminated body, which results in a deterioration in an inductance characteristic and an impedance characteristic, and furthermore, short-circuits among the via-hole conductors are more likely to occur.

FIG. 7 shows a sectional view of such a laminated coil component. Pad portions 56 having relatively large widths are arranged on end portions of coil conductors 55 each of which is interposed between ceramic films 51 so that a connection characteristic is improved. Interlayer connections among the coil conductors 55 are provided through the pad portions 56 and via-hole conductors 57. Furthermore, external electrodes 60 are disposed on both ends of a laminated body. FIG. 8 is an enlarged view illustrating the interlayer connection.

The pad portions 56 have relatively large areas, and the pad portions 56 and the via-hole conductors are produced concurrently by the application of conductive paste. Therefore, the conductive paste is likely to be applied thicker in the portions at which the pad portions 56 and the via-hole conductors 57 overlap one another than in the coil conductors 55, and stress is concentrated on these overlapping portions. Accordingly, an inductance is deteriorated, and defects due to short-circuiting frequently occur. Furthermore, projection portions 59 are generated on the laminated body as shown in FIG. 7, which causes problems when mounting the laminated coil component.

SUMMARY OF THE INVENTION

To overcome the problems described above, preferred embodiments of the present invention provide a laminated coil component which prevents the concentration of stress on portions in which pad portions and via-hole conductors overlap one another, which has excellent characteristics, and which prevents trouble such as defects due to short-circuiting and a failures during mounting.

A preferred embodiment of the present invention provides a laminated coil component including a spiral coil defined by a plurality of laminated ceramic films and coil conductors, the spiral coil includes pad portions provided at end portions of the coil conductors that are connected to one another through via-hole conductors to provide an interlayer connection among the pad portions. The pad portions are thinner than the coil conductors.

In the laminated coil component according to this preferred embodiment of the present invention, since the pad portions are thinner than the coil conductors, the concentration of stress on portions at which the pad portions and the via-hole conductors overlap one another in a laminated body is prevented.

Thicknesses of the pad portions are preferably about 0.31 to about 0.81 times the thicknesses of the coil conductors, for example. If the thicknesses of the pad portions are less than about 0.31 times those of the coil conductors, wire breaking may occur. When the coil conductors have half-turn shapes and are arranged on the corresponding ceramic films, the pad portions and the via-hole conductors overlap one another at two portions. Accordingly, making the pad portions thinner than the coil conductors is especially effective to prevent the stress concentration in the laminated coil component including the coil conductors having such shapes.

Furthermore, in a method for manufacturing the laminated coil component according to another preferred embodiment of the present invention, when coil conductors are printed on ceramic films by screen printing using a screen-printing plate, an opening area ratio of portions of the screen-printing plate which correspond to pad portions is controlled so that thin pad portions are formed. When the opening area ratio is reduced, an amount of conductive paste applied on the ceramic films is reduced. Accordingly, thin pad portions are produced. The opening area ratio of the portions of the screen-printing plate which correspond to the pad portions is preferably in a range from about 25% to about 64%, for example.

According to preferred embodiments of the present invention, since the pad portions provided at the end portions of the coil conductors are thinner than the coil conductors, the concentration of stress on portions at which the pad portions and via-portions overlap one another in a laminated body is prevented, an inductance characteristic and an impedance characteristic are improved, and defects caused by short-circuiting between conductors are prevented. Furthermore, the laminated body is prevented from partially protruding, and problems during mounting are prevented.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a laminated coil component and a method for manufacturing the laminated coil component according to the present invention will be described with reference to the accompanying drawings.

Figure 1:
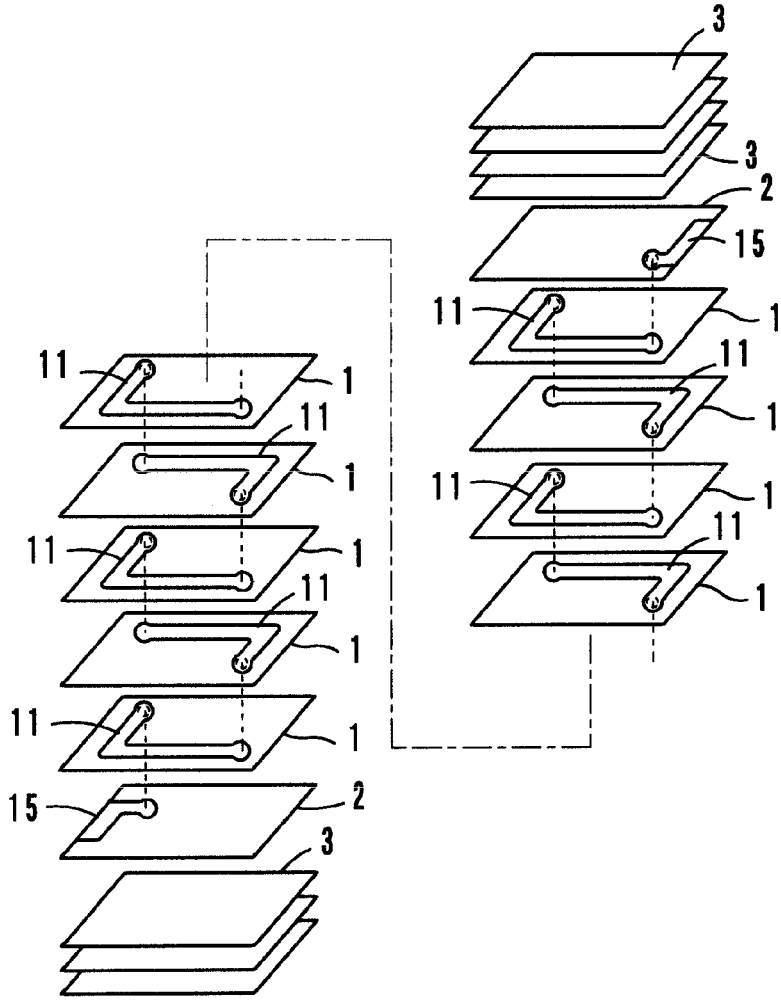
FIG. 1 is an exploded perspective view of a laminated coil component according to a preferred embodiment of the present invention.
Figure 2A:
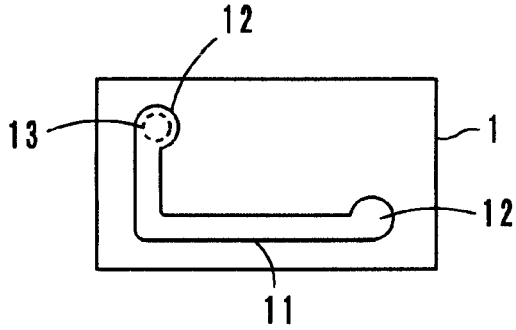
FIGS. 2A and 2B are a plan views of two types of ceramic sheets which define the laminated coil component.
Figure 2B:
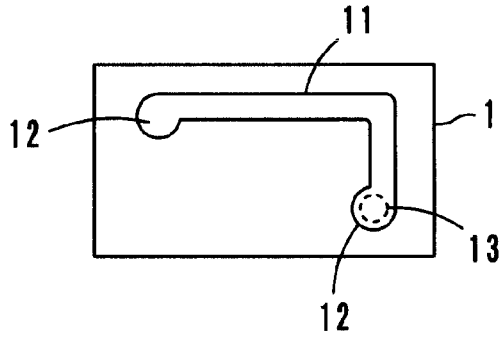

The laminated coil component according to a preferred embodiment of the present invention includes, as shown in FIG. 1, ceramic sheets 1 each including coil conductors 11 having half-turn shapes provided thereon, ceramic sheets 2 each including leading electrodes 15 arranged thereon, and plain ceramic sheets 3. As shown in FIGS. 2A and 2B, pad portions 12 are provided at both ends of each of the coil conductors 11, and at the pad portions 12, via-hole conductors 13 are provided by a conductive material filled in holes. The via-hole conductors 13 are connected to the pad portions 12 under the corresponding via-hole conductors 13, whereby the coil conductors 11 are formed into a spiral coil.

Figure 3:
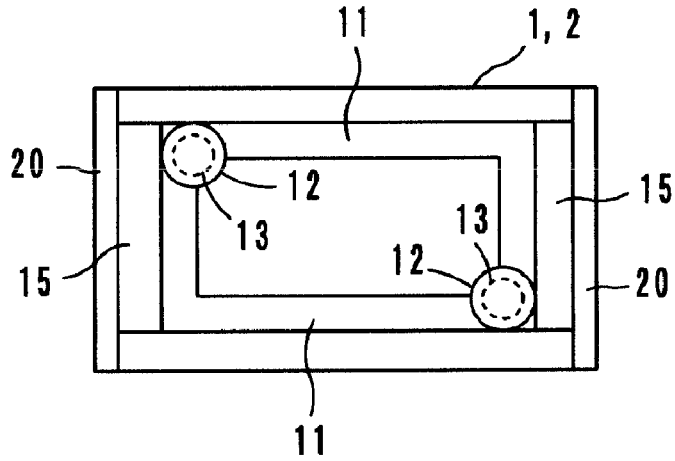
FIG. 3 is a plan view of the laminated coil component viewed in a lamination direction.
Figure 4:
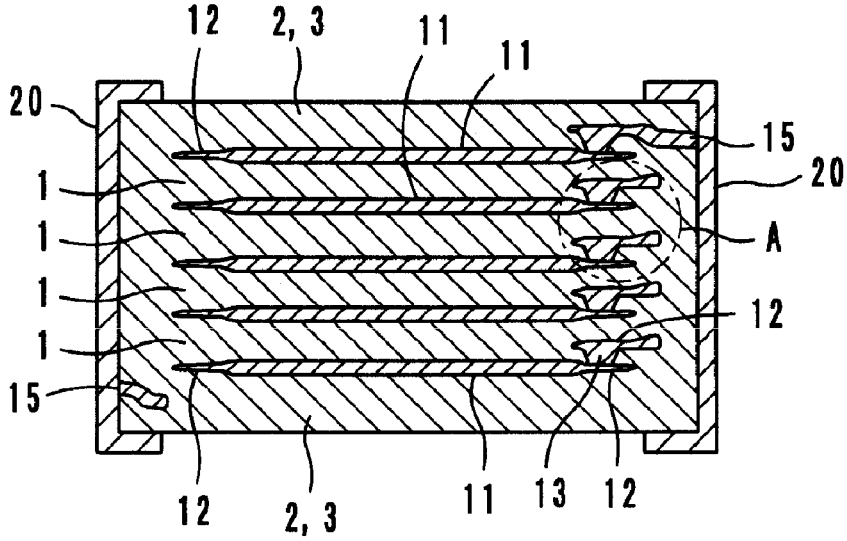
FIG. 4 is a sectional view of the laminated coil component.

FIG. 3 is a plan view viewed a lamination direction and shows a laminated body including the ceramic sheets (ceramic films) 1 and 2 and the coil conductors 11. FIG. 4 is a sectional view of the laminated body in which external electrodes 20 are provided on both end surfaces of the laminated body. Referring to the plan view of FIG. 3, the coil conductors 11 overlap one another in the lamination direction, and the pad portions 12 and the via-hole conductors 13 overlap one another at two portions.

Figure 5:
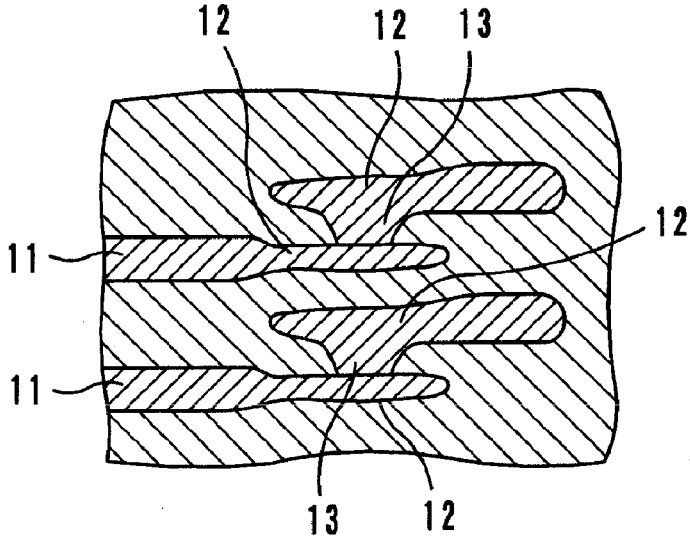
FIG. 5 is an enlarged view of a portion A shown in FIG. 4.
Figure 7:
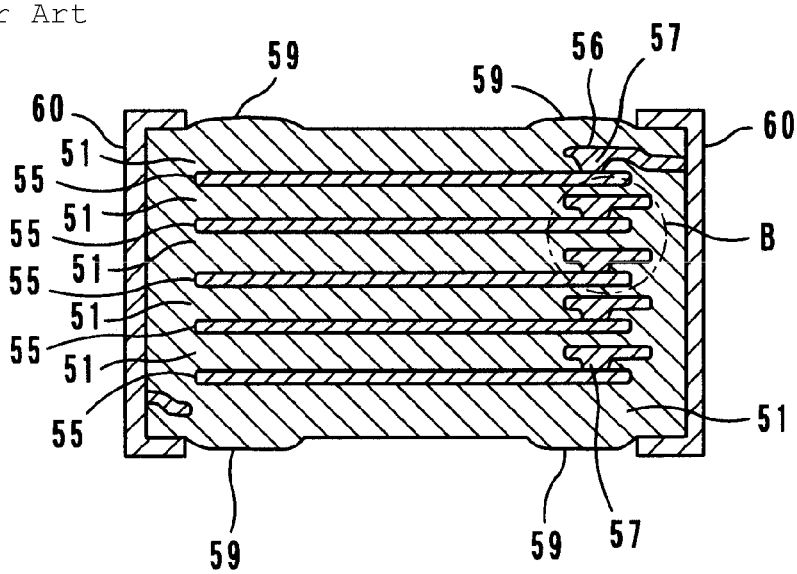
FIG. 7 Prior Art
FIG. 7 is a sectional view of a laminated coil component in the related art.
Figure 8:
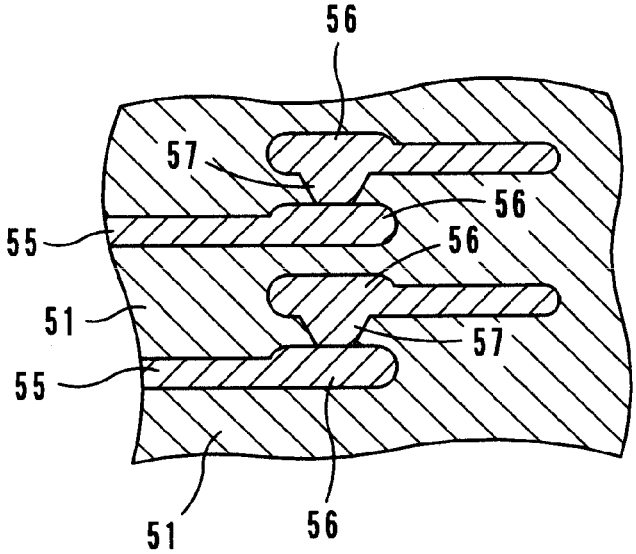
FIG. 8 Prior Art
FIG. 8 is an enlarged view of a portion B shown in FIG. 7.

FIG. 5 is an enlarged view of one of the portions in which the pad portions 12 and the via-hole conductors 13 overlap one another. The pad portions 12 are thinner than the coil conductors 11. Thereby, stress concentrated on the portions in which the pad portions 12 and the via-hole conductors 13 overlap one another is reduced, an inductance characteristic and an impedance characteristic are improved, and defects caused by short-circuiting among the conductors are prevented. An experiment illustrating these advantages will be described later. In addition, the projecting portions 59 as shown in FIG. 7 are not generated on the laminated body, and therefore, problems during mounting are prevented.

The laminated coil component having the configuration described above is manufactured as follows. Two manufacturing methods are described as examples. In a first method, desired patterns are formed of conductive paste on ferrite green sheets having through holes by a printing method, such as screen printing, for example, and the ferrite green sheets are laminated, subjected to pressure bonding, cut and sintered so that a spiral coil is obtained. Thus, a laminated coil component is obtained. In a second method, a ferrite material and a conductive material are alternately printed by a printing method, such as screen printing, for example, so that a spiral coil is obtained, and pressure bonding, cutting, and sintering are performed, whereby a laminated coil component is obtained.

Specifically, the laminated coil component was manufactured through the following steps. First, a material including ferric oxide at a predetermined rate by weight, a material including zinc oxide at a predetermined rate by weight, a material including nickel oxide at a predetermined rate by weight, and a material including copper oxide at a predetermined rate by weight were fed into a ball mill as raw materials and were subjected to wet blending for a predetermined period of time. Then, an obtained mixture was dried and ground, and obtained powder was temporarily burned for an hour at a temperature of about 700° C. The temporarily burned powder was subjected to wet grinding in a ball mill for a predetermined period of time, and dried and disintegrated, whereby ferrite powder was obtained.

Next, a binder resin, a plasticizing agent, a wetting material, and a dispersant were added to the ferrite powder, and the ferrite powder was mixed with the binder resin, the plasticizing agent, the wetting material, and the dispersant for a predetermined period of time in the ball mill. Thereafter, an obtained mixture was subjected to defoaming by decompression, whereby a slurry was obtained. The slurry was applied to a peelable film using a lip coater or a doctor blade and was dried, whereby a long ferrite green sheet having a predetermined film thickness was obtained.

Then, the ferrite green sheet was cut into ferrite sheet pieces having a predetermined size. Through holes for via-hole conductors were formed in the ferrite sheet pieces at predetermined locations using laser beams. Then, conductive paste primarily including silver or silver alloy was applied on the sheet pieces into predetermined patterns by screen printing, and then, the sheet pieces were dried with heat. In this manner, coil conductors, pad portions, and via-hole conductors were formed on the sheet pieces. The sheet pieces which were obtained at this stage had conductive layers on surfaces thereof as shown in FIGS. 2A and 2B. In addition, sheet pieces having leading electrodes at end portions thereof, as shown in FIG. 1, were also manufactured.

The obtained sheet pieces were laminated on one another, and in addition, the laminate of the sheet pieces was sandwiched between plain protective sheet pieces. Consequently, the coil conductors were connected to one another through the pad portions and the via-hole conductors arranged at the end portions of the coil conductors, whereby a spiral coil is obtained.

In this manner, a non-sintered laminate was manufactured, and then, the non-sintered laminate was subjected to pressure bonding with pressure of about 1.0 t/cm$^2$ at a temperature of about 45° C. This laminated-and-bonded body was cut into pieces having a predetermined size using a dicer or a press-cutting blade, whereby a non-sintered body of a laminated coil component (laminated ceramic inductor) was obtained. The obtained non-sintered inductor was subjected to a binder-removing process and a sintering process. The non-sintered inductor was heated for two hours in a hypoxic atmosphere of about 500° C. in the binder-removing process, and then subjected to the sintering process for about 150 minutes in an air atmosphere of about 890° C. Then, conductive paste primarily including silver was applied to both end surfaces (surfaces on which the leading electrodes are exposed) of the sintered body by a dipping method. Then, the sintered body was dried for about 10 minutes at a temperature of about 100° C. and burned for about 15 minutes at a temperature of about 800° C., so that the conductive paste applied on the both end surfaces was formed into external electrodes. Thus, a laminated chip inductor having external electrodes on both end surfaces and including a coil was obtained. The laminated coil component thus manufactured was used as a sample according to this preferred embodiment.

Figure 6:
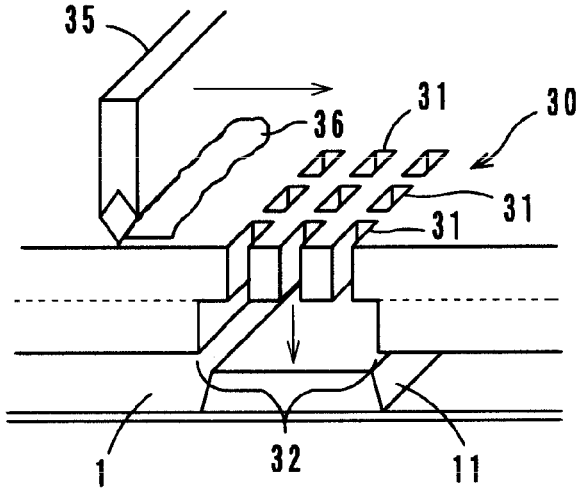
FIG. 6 is a perspective view of an opening portion of a screen-printing plate.

As shown in FIG. 6, a screen-printing plate 30 includes openings 31 arranged in a mesh in a graphic portion 32 to be printed (having a shape corresponding to a pattern of the coil conductors 11 or the pad portions 12). In FIG. 6, reference numeral 35 denotes a squeegee, and reference numeral 36 denotes conductive paste.

When the coil conductors 11 are printed on the ceramic sheets 1 by screen printing, an opening area ratio of portions of the screen-printing plate 30 which correspond to the pad portions 12 is set so that the pad portions 12 are made thinner than the coil conductors 11 as shown in FIGS. 4 and 5. In the following description, values specified as the opening area ratio of the pad portions 12 are percentages of the area of the openings 31 provided to print each of the pad portions 12 to the area of the graphic portion 32 corresponding to each of the pad portions 12. Preferable values for the opening area ratio will be described later.

Note that the graphic portion 32 is not necessarily required on the screen-printing plate 30, and the opening area ratio may be calculated as a percentage to the area of a pad portion 12.

The manufactured laminated chip inductor had a length of about 0.4 mm, a width of about 0.2 mm and a height of about 0.2 mm, and includes a coil winding of about 10.5 turns. Each of the ceramic sheets 1 had a thickness of about 8 μm (about 5 μm after sintering), each of the coil conductors 11 had a thickness of about 10 μm (about 8 μm after sintering) and a line width of about 35 μm (about 55 μm after pressure bonding and about 45 μm after sintering), and each of the pad portions 12 had a thickness of about 6.25 μm (about 5 μm after sintering) and a diameter of about 55 μm (about 80 μm after pressure bonding and about 65 μm after sintering). In this preferred embodiment, the opening area ratio of the pad portions 12 was about 49%. As a comparative example, a laminated chip inductor having substantially the same size as that of this preferred embodiment was manufactured by not specifically setting the opening area ratio of the screen-printing plate 30. Specifically, the opening area ratio of the coil conductors 11 and the opening area ratio of the pad portions 12 were both about 81%. In this comparative example, each of the pad portions 12 had a thickness of about 11 μm (about 9 μm after sintering).

Table 1 shows the inductance characteristics, the impedance characteristics, the ratios of defects caused by short-circuiting and the surface roughnesses of the laminated bodies of this preferred embodiment and the comparative example in which the opening area ratio of the screen-printing plate 30 of the pad portions 12 is not specifically set.

TABLE 1

| | INDUCTANCE (1 MHz) nH | IMPEDANCE (100 MHz) Ω | SHORT-CIRCUIT DEFECT RATIO (%) | SURFACE ROUGHNESS (μm) |
|---|---|---|---|---|
| THIS PREFERRED EMBODIMENT | 512 | 125 | 0 | 1 |
| COMPARATIVE EXAMPLE | 365 | 101 | 7 | 4 |

As is clear from Table 1, the inductance characteristic and the impedance characteristic of this preferred embodiment produces preferable values as compared to those of the comparative example. Furthermore, in this preferred embodiment, the ratio of defects caused by short-circuiting was 0%, and the surface roughness was only about 1 μm.

Table 2 shows the ratios of defects caused by short-circuiting, the surface roughnesses, and the ratios of defects caused by breaking of the laminated coil components manufactured by changing the opening area ratio of the portion of the screen-printing plates 30 to print the pad portions 12 in a range from about 100% to about 16%. As the opening area ratio was changed in the range from about 100% to about 16%, the ratio of the thickness of the pad portions 12 to the thickness of the coil conductors 11 (hereinafter referred to as a "thickness ratio") was also changed in a range from about 1.25 to about 0.19.

TABLE 2

| APERTURE RATIO (%) | THICKNESS OF PAD PORTION AFTER SINTERING (μm) | RATE RELATIVE TO THICKNESS OF COIL CONDUCTOR | SHORT-CIRCUIT DEFECT RATIO (%) | SURFACE ROUGHNESS (μm) | BREAKING DEFECT RATIO (%) |
|---|---|---|---|---|---|
| 100 | 10.0 | 1.25 | 12 | 8 | 0 |
| 81 | 9.0 | 1.13 | 7 | 4 | 0 |
| 73 | 8.0 | 1.00 | 5 | 4 | 0 |
| 64 | 6.5 | 0.81 | 0 | 2 | 0 |
| 49 | 5.0 | 0.63 | 0 | 1 | 0 |
| 36 | 4.0 | 0.50 | 0 | 1 | 0 |
| 25 | 2.5 | 0.31 | 0 | 1 | 0 |
| 16 | 1.5 | 0.19 | 0 | 1 | 4 |

Thicknesses of coil conductors after sintering: 8 μm

When the opening area ratio was about 73%, about 81% (the comparative example) and about 100%, the thicknesses of the pad portions 12 were relatively large, and the thickness ratio was about 1.00, about 1.13 and about 1.25, and the ratio of defects caused by short-circuiting and the surface roughness were not improved. When the opening area ratio was about 16% (a thickness ratio of about 0.19), although the ratio of defects caused by short-circuiting and the surface roughness were improved, the exceedingly thin pad portions 12 might lead to defects caused by breaking, which is not preferable. Therefore, the opening area ratio is preferably set in a range from about 25% to about 64%, for example. The thickness ratio is preferably set in a range from about 0.31 to about 0.81, for example. Note that the relationship between the opening area ratio and the thickness ratio may change depending on the line widths of the coil conductors 11, and/or the diameters of the pad portions 12 and the via-hole conductors 13.

The laminated coil component and the method for manufacturing the same according to the present invention are not limited to the foregoing preferred embodiment, and various modifications may be made within the scope of the invention.

For example, coil conductors each arranged on ceramic films are not necessarily of half-turn shapes, and the coil conductors may have shapes of more than half turns or less than half turns. The coil conductors may have one-turn shapes or two-turn shapes. The present invention is applicable to not only laminated inductors but also LC composite components.

As described above, the present invention is effectively applicable to laminated coil components, such as chip inductors, and is capable of preventing a local concentration of stress on a laminated body and improves the characteristics of the laminated coil components.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A laminated coil component comprising:

a spiral coil including a plurality of laminated ceramic films and coil conductors, said spiral coil including pad portions provided at end portions of the coil conductors connected to one another through via-hole conductors to define an interlayer connection among the pad portions; wherein maximum thicknesses of the pad portions are less than maximum thicknesses of the coil conductors in a lamination direction of the laminated ceramic films and the coil conductors.

2. The laminated coil component according to claim 1, wherein the maximum thicknesses of the pad portions are about 0.31 to about 0.81 times the maximum thicknesses of the coil conductors.

3. The laminated coil component according to claim 1, wherein each of the coil conductors has a half-turn shape and is arranged on a corresponding one of the ceramic films.

* * * * *